US007363790B2

(12) United States Patent
Kruger et al.

(10) Patent No.: US 7,363,790 B2
(45) Date of Patent: Apr. 29, 2008

(54) METHOD FOR VACCUM ASSISTED PREFORMING OF SUPERPLASTICALLY OR QUICK PLASTICALLY FORMED ARTICLE

(75) Inventors: Gary A. Kruger, Troy, MI (US); Chongmin Kim, Bloomfield Township, MI (US); Richard H. Hammar, Utica, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 414 days.

(21) Appl. No.: 11/215,393

(22) Filed: Aug. 30, 2005

(65) Prior Publication Data

US 2007/0044529 A1 Mar. 1, 2007

(51) Int. Cl.
*B21D 26/02* (2006.01)

(52) U.S. Cl. ..... 72/57; 72/60; 72/709; 29/421.1

(58) Field of Classification Search ..... 72/56, 72/57, 60, 63; 29/421.1
See application file for complete search history.

(56) References Cited

U.S. PATENT DOCUMENTS 4,045,986 A * 9/1977 Laycock et al. ..... 72/60
5,647,239 A * 7/1997 Fischer ..... 72/60
5,823,032 A * 10/1998 Fischer ..... 72/60
6,253,588 B1 7/2001 Rashid et al. ..... 72/57
6,581,428 B1 * 6/2003 Friedman ..... 72/57
6,832,501 B2 * 12/2004 Gruszka et al. ..... 72/57
6,880,377 B2 * 4/2005 Kim et al. ..... 72/57
6,886,383 B2 5/2005 Kim et al. ..... 72/57

* cited by examiner

*Primary Examiner*—David B Jones

(57) ABSTRACT

Method of preforming and forming a sheet metal article from a preheated blank of sheet metal uses opposing dies including a punch having a punch surface defining a final configuration for the article and a cavity die having a cavity surface defining a preform configuration. The blank is placed between the dies and has a first side surface facing the cavity die and a second side surface facing the punch. A vacuum is applied to the first side of the blank to draw and shape the blank into the cavity die to a preform configuration conforming to the cavity surface. The punch and the cavity die are then closed toward one another and gas pressure is then applied to the first side surface of the blank to press the second side surface against the punch surface to the finish configuration.

17 Claims, 4 Drawing Sheets

METHOD FOR VACCUM ASSISTED PREFORMING OF SUPERPLASTICALLY OR QUICK PLASTICALLY FORMED ARTICLE

FIELD OF THE INVENTION

The present invention relates to high temperature forming of superplastically formable or quick plastically formable metal alloy sheet blanks into complexly shaped articles such as an automotive decklid. More particularly the invention relates to a method in which the preheated sheet metal blank is preformed into a cavity die by the application of a vacuum to the cavity, prior to the application of high pressure to stretch the preformed panel over a punch die.

BACKGROUND OF THE INVENTION

Automotive body panels and other sheet metal parts of complex shape can be formed from aluminum alloy of superplastically or quick plastically formable composition and metallurgical microstructure. In general, a preheated sheet metal blank, such as Aluminum Alloy 5083 is preheated and placed between a heated cavity die and heated punch die for stretch forming the blank into contact with the punch die to form the desired complex shape.

SUMMARY OF THE INVENTION

A method of preforming and forming a sheet metal article from a blank of sheet metal that has been heated for stretch forming is performed using a set of opposing dies including a punch die having a punch surface defining a predetermined final configuration for the article and a cavity die having a cavity surface defining a preform configuration for the article. A heated blank is placed between the opposing dies, the blank having a first side surface facing the cavity die and a second side surface facing the punch die. A vacuum is applied to the first side of the blank to draw and shape the blank into the cavity die to a preform configuration that conforms at least generally to the cavity surface. The punch and the cavity die are then closed toward one another so that the punch die is positioned close to the preformed blank. Gas pressure is then applied to the first. side surface of the blank to press the second side surface against the punch die, thereby shaping the blank from the preform configuration defined by the cavity die, to the finish configuration defined by the punch die.

Further areas of applicability of the present invention will become apparent from the detailed description provided hereinafter. It should be understood that the detailed description and specific examples, while indicating an embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE EXEMPLARY EMBODIMENTS

The following description of the preferred embodiment(s) is merely exemplary in nature and is in no way intended to limit the invention, its application, or uses.

Figure 1:
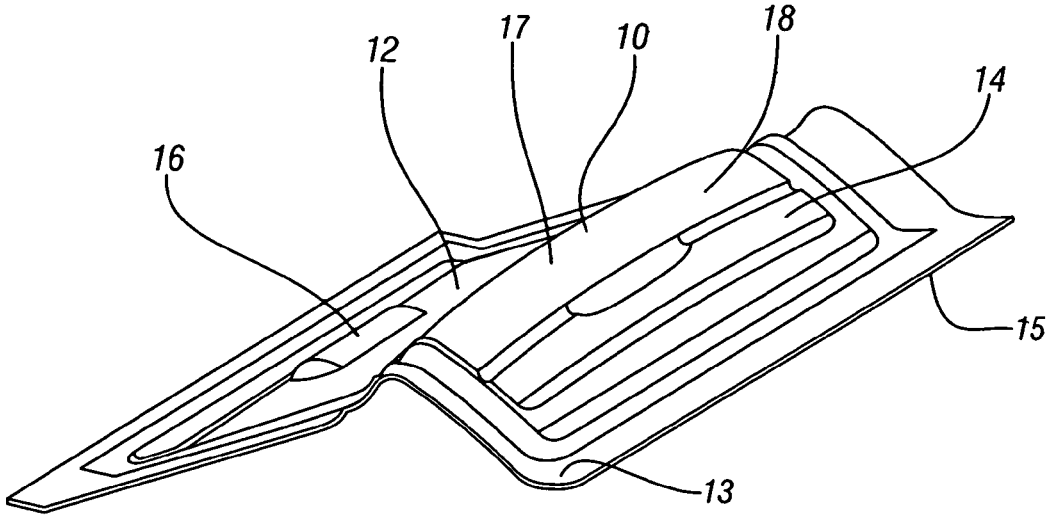
FIG. 1 is a perspective view of a formed article.

FIG. 1 shows a perspective view of a formed article, in particular a decklid panel 10 for a vehicle. The decklid panel 10 is generally a rectangular sheet metal panel 12 that is formed to desired contours and is shown in FIG. 1 in its condition having been formed between a pair of dies and prior to its being trimmed to remove excess metal periphery 13 that extends integrally from the surface 12. The decklid 10 has a first side surface 14 that will be the exterior of the decklid 10 and second side surface 15 that will be the interior of the decklid 10. The panel 12 has been shaped to provide the desired final formed configuration of the decklid panel 10. The decklid panel includes regions of generally shallow draw and other regions of relatively deep draw. In particular, the regions of deep draw include a raised area 16 and a raised area 17. The raised areas 16 and 17 present a challenge in the die forming of the decklid panel because the degree of stretching and forming of the metal that is required may lead to thinning and folding and wrinkling of the metal at and adjoining these raised areas.

Figure 2:
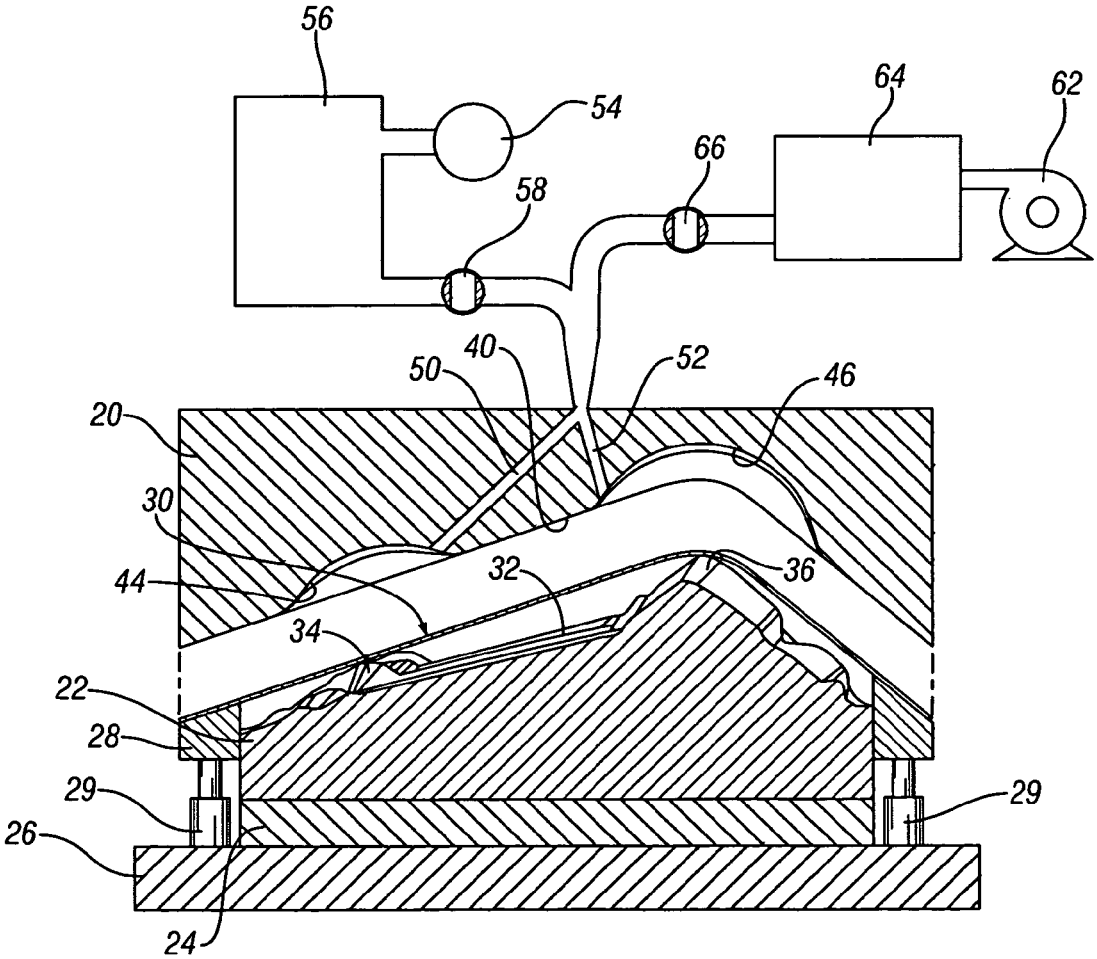
FIG. 2 is a cross sectional view showing the forming dies open relative one anther and a preheated blank of sheet metal draped over the punch die.

FIG. 2 shows a press and tooling apparatus in which a cavity die 20 is positioned above a punch die 22. The cavity die 20 is seated on a load bearing insulation (not shown). The punch die 22 is seated on a load bearing insulation 24 that in turn is seated on a lower platen 26 of the press. A binder ring 28 surrounds the punch die and is mounted on the lower platen 26 by a plurality of cylinders 29. FIG. 2 shows a preheated sheet metal blank 30 that is draped over the punch die 22.

The punch die 22 has a die surface 32 that corresponds precisely with the second side surface 15 of the formed decklid panel 10, and has in particular crown regions 34 and 36 for forming the raised areas 16 and 17 of the formed decklid panel 10.

The cavity die 20 has a die surface 40 that is shaped to preform the blank 30, including the raised areas 16 and 17 thereof. In particular, the cavity die 20 has recessed regions at 44 and 46 that overlie and register with the crown regions 34 and 36 of the punch die 22.

Figure 3:
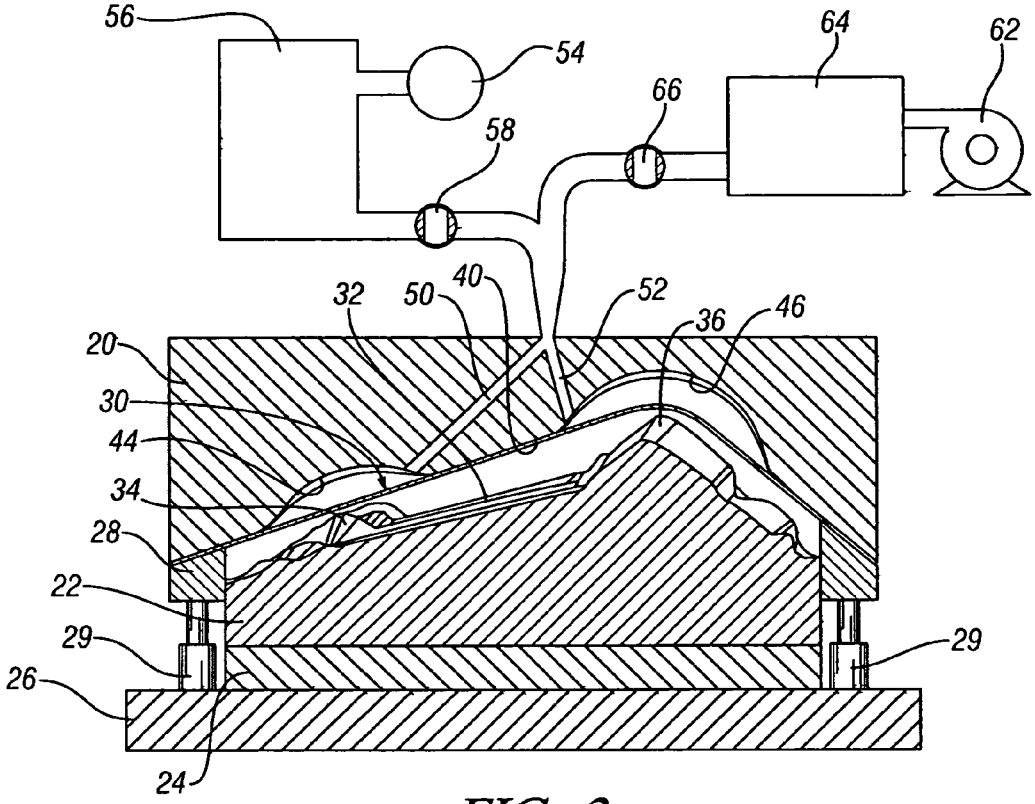
FIG. 3 shows the blank bound to the cavity die by a binder ring.
Figure 4:
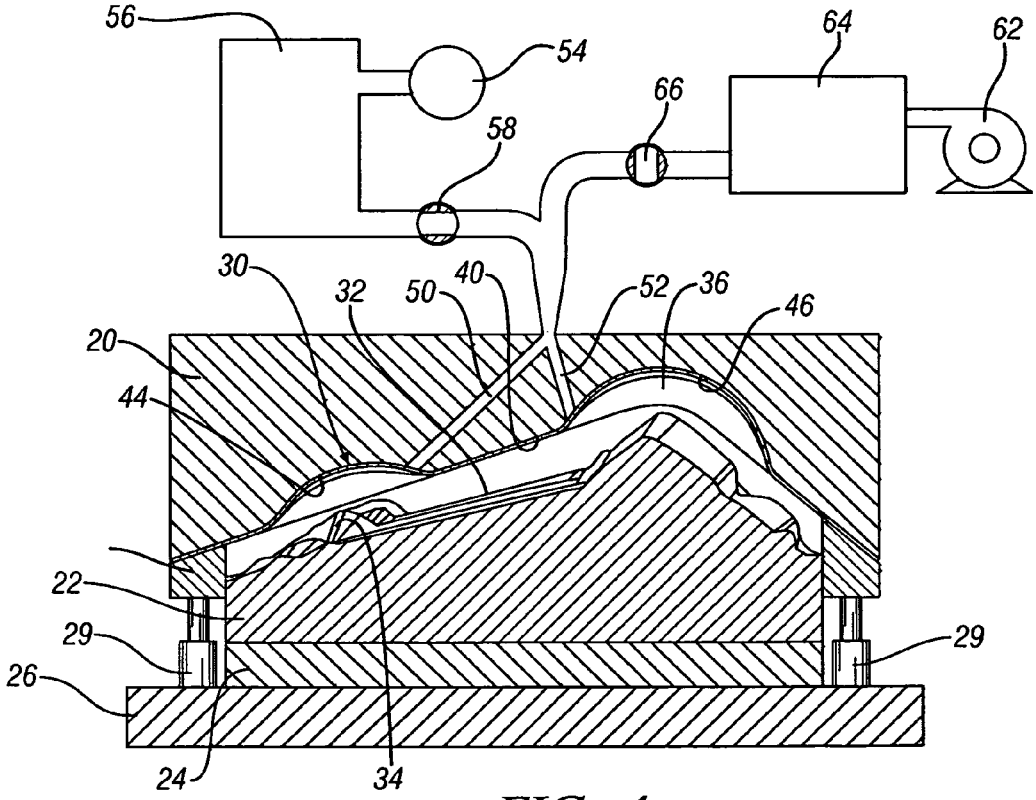
FIG. 4 shows the application of a vacuum to preform the blank against the cavity die.

Referring to FIG. 3 it is seen that the cavity die 20 has been partially closed relative the punch die 22 and brought to rest on the binder ring assembly 28 so that the periphery 13 of the blank 30 has become bound to the cavity die 20 in airtight relation therewith. The cavity die 20 has passages 50 and 52 that communicate with the recessed cavity regions 44 and 46 of the cavity die 20 and connect with a vacuum pump 54 and vacuum reservoir 56 via a valve 58. Opening of the valve 58, as shown in FIG. 4, causes the evacuation of the recessed cavity regions 44 and 46 to thereby vacuum preform the preheated blank 30 against the die surface 40 of the cavity die 20 and deeply draw the blank 30 into the recessed regions 44 and 46.

Figure 5:
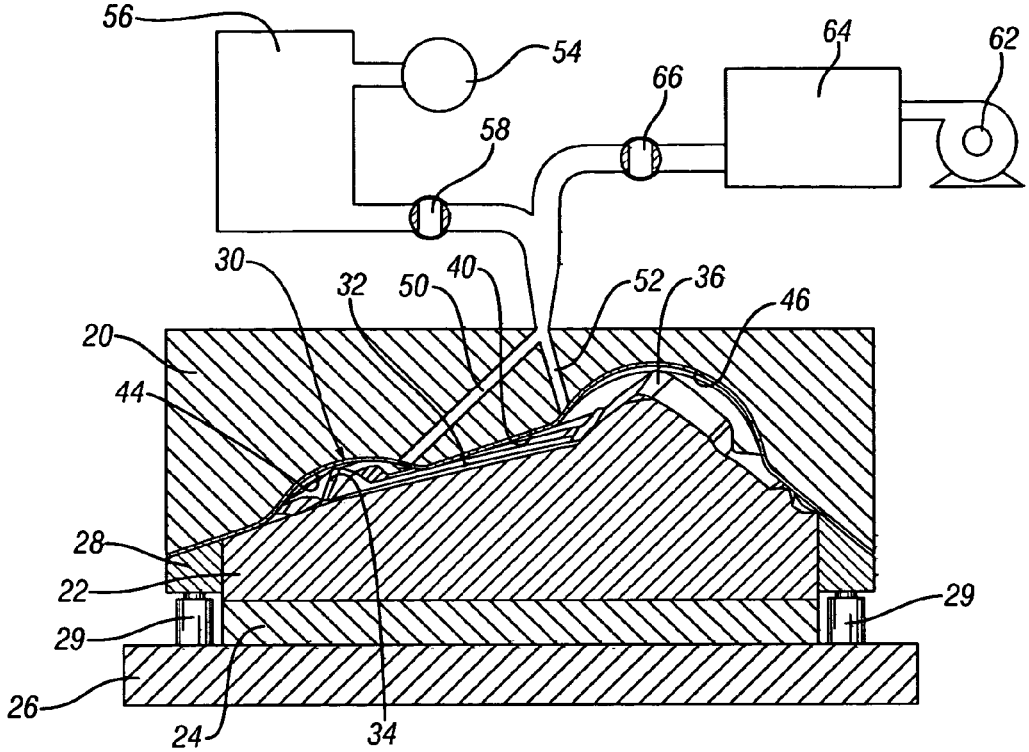
FIG. 5 shows the cavity die and the punch die fully closed relative one another.

Referring to FIG. 5, it is seen that the vacuum valve 58 has been closed, and the cavity die 20 has been fully closed against the punch die 22 so that the die surface 32 of the punch die 22 is positioned in close proximity with the preformed blank 30. The crown regions 34 and 36 of the punch die 22 are thus closed into proximity with those portions of the blank 30 that have been drawn into the recessed cavities 44 and 46 of the cavity die 20.

Figure 6:
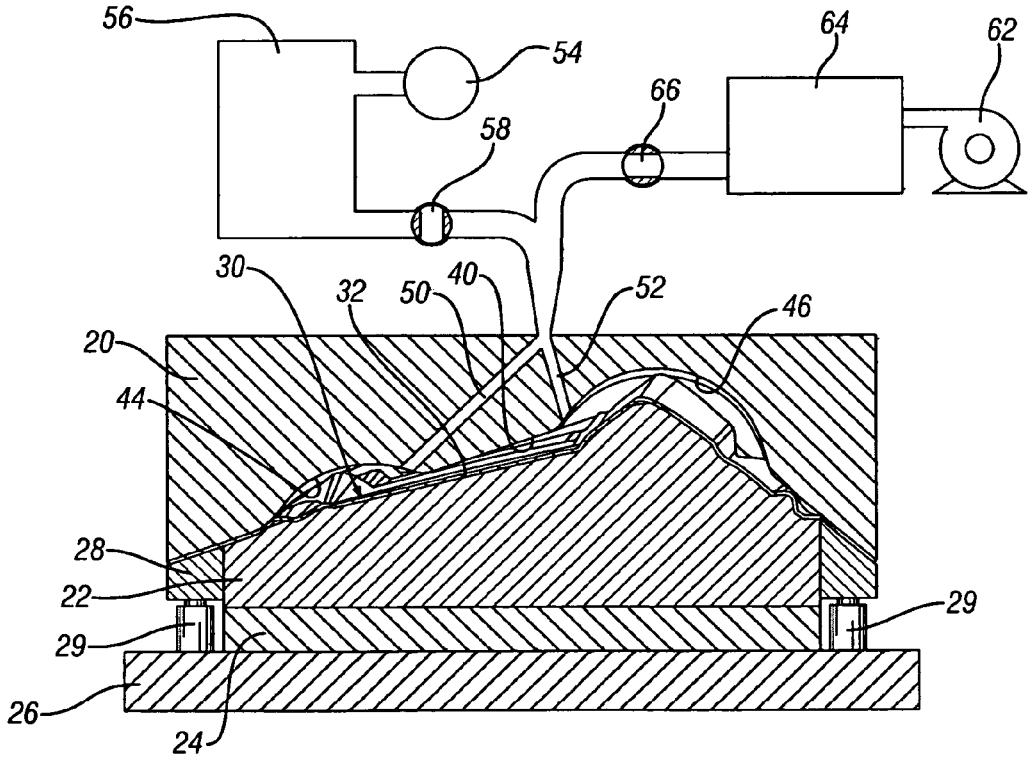
FIG. 6 shows the application of high pressure to form the blank against the punch die.

Referring to FIG. 6, it is seen that the passages 50 and 52 have been connected to a high pressure pump 62 and its reservoir 64 by a valve 66. The pressure is progressively increased to pressure form and stretch the blank 30 over the die surface 32 of the punch die 22, including its crown regions 34 and 36.

After complete forming of the blank 30 to the precise and finished shape defined by the die surface 32 of the punch die 22, the valve 66 is closed to shut off the high pressure and the press and the dies are returned to the full open positions of FIG. 2 so that the finished decklid panel 10 is ejected and removed.

Figure 7A:
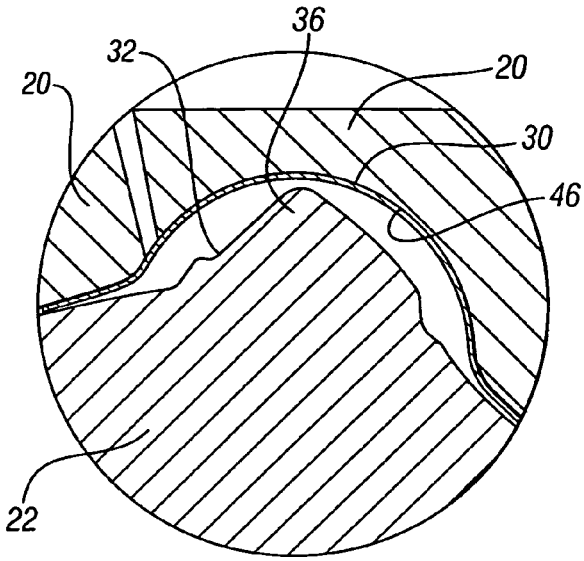
FIGS. 7A, 7B, and 7C are enlarged fragmentary views of showing variations in die closing and vacuum performing steps of the preforming method.
Figure 7B:
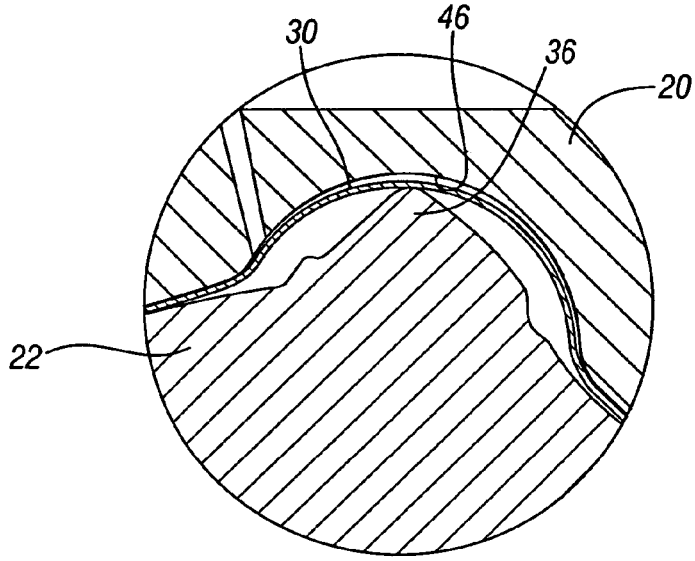
Figure 7C:
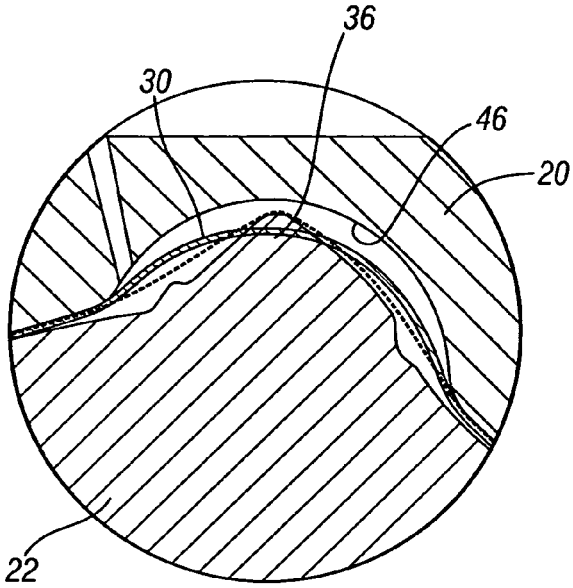

Referring to FIGS. 7A, 7B, and 7C, it will be appreciated that the method of this invention. may be varied in order to obtain optimal forming of the formed panel, free of wrinkling or folding, and excessive thinning of the sheet material regardless of the substantial degree of stretching and forming that is required in the region of the raised areas 16 and 17. In these Figures, the blank is shown at its vacuum preformed position obtained as a result of the application of vacuum pressure according to the process step at FIG. 5.

More particularly, in FIG. 7A, it is seen that the vacuum has been applied for a time and a pressure sufficient to completely withdraw the blank 30 into complete and full contact with the cavity recess 46. FIG. 7A also shows that the cavity die 20 and the punch die 22 have been fully closed relative one another, and it will be seen and appreciated that the crown 36 of the punch die 22 is so spaced to avoid contact with the blank 30. Upon the subsequent application of high pressure, as in the process step of FIG. 6, the blank 30 will be formed into full and complete contact with the surface 32 of the punch die 22 and its crown 36.

FIG. 7B shows that the blank 30 has not been withdrawn completely into full contact with the cavity recess 46. FIG. 7B also shows that the cavity die 20 and the punch die 22 have been fully closed relative one another, and it will be seen and appreciated that the crown 36 of the punch die 22 has come into contact with the blank 30. Upon the subsequent application of high pressure, as in the process step of FIG. 6, the blank 30 is formed into full and complete contact with the surface 32 of the punch die 22 and its crown 36.

FIG. 7C shows that the blank 30 has not been withdrawn completely into full contact with the cavity recess 46, so that upon full closure of the cavity die 20 and the punch die 22 relative to one anther, the crown 36 of the punch die 22 has come into contact with the blank 30 and formed and stretched the blank 30 to the position shown by dotted lines in FIG. 7C. Upon the subsequent application of high pressure, as in the process step of FIG. 6, the blank 30 is formed into full and complete contact with the surface 32 of the punch die 22 and its crown 36.

It will be understood that the methods of FIGS. 7A, 7B and 7C are each effective to make a decklid panel 10. In some instances the occurrence of one of these conditions may result from process variations such as variations in the vacuum pressure, the duration of the application of the vacuum, the metallurgical composition of the blank, or the temperature of the blank. In other instances, the process may be closely controlled and conducted to consistently obtain one of these processes that is found to produce the highest quality of formed parts.

It will also be understood that it may be advantageous to perform the step of closing the cavity die 20 and the punch die 22 relative to one another at the same time that the vacuum is being applied to withdraw the blank 30 against the cavity die 20. For example, the cycle time of the press and tooling apparatus may be reduced in this fashion. In addition, it may be desirable to have the crowns 34 and/or 36 assist the vacuum by physically nudging the blank 30 into the cavity recesses 44 and/or 46 at the same time that the vacuum is withdrawing the blank 30 into these cavity recesses.

The description of the invention is merely exemplary in nature and, thus, variations that do not depart from the invention are intended to be within the scope of the invention. Such variations are not to be regarded as a departure from the spirit and scope of the invention.

What is claimed is:

1. A method of preforming and forming a sheet metal article from a blank of sheet metal that has been heated for stretch forming, the method being performed using a set of opposing dies including a punch die having a punch surface defining a predetermined final configuration for the article and a cavity die having a cavity surface defining a preform configuration for the article, the method comprising:

placing the heated blank between the opposing dies, the blank having a first side surface facing the cavity die and a second side surface facing the punch;

applying a vacuum to the first side of the blank to stretch and shape the blank in a preform configuration that conforms at least generally to the cavity surface;

closing the punch and the cavity die toward one another;

and applying gas pressure to the first side surface of the blank to press the second side surface against the punch surface, to shape the blank from the preform configuration to the finish configuration.

2. The method of claim 1 in which the cavity die is shaped to define a preform configuration of the panel that substantially positions the heated blank at a location such that the punch does not deform the blank upon the step of closing the punch and the cavity die toward one another.

3. The method of claim 1 in which the vacuum is applied to the first side surface and the dies are closed toward one another simultaneously.

4. The method of claim 1 in which the punch die is carried into contact with the blank during the step of closing the punch die and the cavity die toward one another so the punch die assists the vacuum in preforming the blank by pushing against the second surface of the blank prior to the step of applying pressure to the first surface of the blank.

5. The method of claim 4 in which the vacuum is applied to the first side surface and the dies are closed toward one another simultaneously.

6. The method of claim 1 in which the article has one or more regions of relatively shallow draw and regions of relatively deep draw, and the cavity die has a relatively deep cavity recess that registers with the regions of relatively deep draw of the article so that the application of vacuum substantially preforms the regions of relatively deep draw.

7. The method of claim 6 in which the punch die has a crown that registers with the regions of relatively deep draw and upon closing of the dies relative one another the crown of the punch die assists the vacuum in performing the blank in the regions of relatively deep draw.

8. The method of claim 6 in which the cavity die has a gas inlet that communicates with the cavity recess of the cavity die and the gas inlet is alternatively connected with the vacuum pressure source and a high pressure source.

9. A method of preforming and forming a sheet metal article from a blank of sheet metal that has been heated for stretch forming, the method being performed using a set of opposing dies including a punch having a punch surface defining a predetermined final configuration for the article and a cavity die having a cavity surface defining a preform configuration for the article, the method comprising:

placing the blank between the spaced apart opposing dies, the blank having a first side surface facing the cavity die and a second side surface facing the punch die;

binding the blank to the cavity die in gas tight relation therewith;

applying a vacuum to the first side of the blank to stretch and shape the blank to a preform configuration that conforms generally to the cavity surface;

closing the punch and the cavity die toward one another so that the punch die contacts a part of the second surface of the blank to assist the vacuum in shaping the blank to the preformed configuration;

and applying gas pressure to the first side surface of the blank to press the second side surface against the punch surface, to further shape the blank to the finish configuration.

10. The method of claim 9 in which the steps of applying the vacuum to the first side surface and the dies and the step of closing the dies toward one another occur simultaneously.

11. The method of claim 10 in which the punch die is carried into contact with the blank during the step of closing the punch and the cavity toward one another so the punch further preforms the blank by pushing against the second surface of the blank and the blank is simultaneously at least partially formed to the final shape of the punch die.

12. The method of claim 9 in which the article has one or more regions of relatively shallow draw and regions of relatively deep draw, and the cavity die has a relatively deep cavity recess that registers with the regions of relatively deep draw of the article so that the application of vacuum substantially preforms the regions of relatively deep draw.

13. The method of claim 12 in which the punch die has a crown that registers with the regions of relatively deep draw and upon closing of the dies relative one another the crown of the punch die assists the vacuum in preforming the blank in the regions of relatively deep draw.

14. A method of preforming and forming a sheet metal article having a raised area region requiring a deep draw of a blank of sheet metal, the method comprising:

providing a punch die having a punch surface over which the blank is to be stretched to define the final configuration of the article, the punch die including a crown portion to define the raised area region;

providing a cavity die that opposes the punch die and having a cavity surface that defines a preform configuration of the article, including a deep draw cavity recess portion that registers with the crown portion of the punch die;

placing a preheated blank between the spaced apart opposing dies, the blank having a first side surface facing the cavity die and a second side surface facing the punch die;

binding the blank to the cavity die in gas tight relation therewith;

applying a vacuum to the first side of the blank to stretch and shape the blank to a preform configuration that conforms generally to the cavity surface and deep draws the blank into the deep draw cavity recess of the cavity die;

closing the punch die and the cavity die toward one another;

and applying high gas pressure to the first side surface of the blank to press the second side surface against the punch surface, to form and shape the preformed blank to the finish configuration including forming of the blank over the crown portions of the punch die.

15. The method of claim 14 in which the crown of the punch die makes contact with the blank during the vacuum preforming of the blank so that the punch die assists in preforming the blank by pushing the blank into the cavity recess portion of the cavity die.

16. The method of claim 15 in which the steps of applying the vacuum to the first side surface and the dies and the step of closing the dies toward one another occur simultaneously.

17. The method of claim 14 in which the cavity die has a gas inlet that communicates with the cavity recess of the cavity die and the gas inlet is alternatively connected with one of either no pressure source, the vacuum pressure source and a high pressure source.

* * * * *